US005553660A

United States Patent [19]

Krause et al.

[11] Patent Number: 5,553,660

[45] **Date of Patent: *Sep. 10, 1996**

[54] METHOD FOR CONTINUOUSLY CASTING COPPER ALLOYS

[75] Inventors: Andreas Krause; Horst Gravemann, both of Osnabruck, Germany

[73] Assignee: KM-Kabelmetal Aktiengesellschaft, Osnabruck, Germany

[ * ] Notice: The term of this patent shall not extend beyond the expiration date of Pat. No. 5,265,666.

[21] Appl. No.: 345,288

[22] Filed: Nov. 28, 1994

Related U.S. Application Data

[63] Continuation of Ser. No. 60,203, May 7, 1993, abandoned, which is a continuation-in-part of Ser. No. 832,923, Feb. 10, 1992, Pat. No. 5,265,666.

[30] Foreign Application Priority Data

Feb. 9, 1991 [DE] Germany ..... 41 03 963.7

[51] Int. Cl.[6] ..... B22D 27/02

[52] U.S. Cl. ..... 164/468; 164/478; 164/484

[58] Field of Search ..... 164/468, 478, 164/484, 504

[56] References Cited

FOREIGN PATENT DOCUMENTS

| | | | |
|---|---|---|---|
| 58-119445 | 7/1983 | Japan | 164/468 |
| 64-40152 | 2/1989 | Japan | 164/468 |

*Primary Examiner*—Kuang Y. Lin
*Attorney, Agent, or Firm*—Kenyon & Kenyon

[57] ABSTRACT

To continuously cast thin slabs or round ingots from copper alloys, which slabs or ingots have a thickness of 8 to 40 mm, the present method electromagnetically agitates the melt found inside the ingot mold. By properly dimensioning the agitator coil, the agitation power inside the melt is limited to within a range of about 0.5 to 100 W/cm3, while the pull-off rate of the casting strand is limited to within a range of 0.05 to 1.3 m/min. The copper alloys contain up to a maximum of 1% of one element selected from the group consisting of iron, cobalt, manganese, zinc, zirconium, chromium, molybdenum and niobium.

14 Claims, 1 Drawing Sheet

METHOD FOR CONTINUOUSLY CASTING COPPER ALLOYS

RELATED APPLICATION

This application is a continuation of U.S. Ser. No 08/060,203, filed May 7, 1993, now abandoned, which is a continuation-in-part of U.S. Ser. No. 07/832,923, filed Feb. 10, 1992, now U.S. Pat. No. 5,265,666.

BACKGROUND OF THE INVENTION

The present invention relates generally to methods for continuously casting thin slabs or round ingots, and more particularly to a method for continuously casting thin slabs or round ingots that have a thickness of 8 to 40 mm from copper alloys, which tend to segregate during solidification.

When conventional casting methods are used, copper-nickel-tin alloys with higher nickel and tin concentrations, e.g. 15% nickel and 8% tin, in particular, tend to form considerable liquations during solidification. This causes segregations to occur at the grain boundaries, which segregations are heavily enriched with tin. Moreover, the cast structure is relatively coarse-grained, whereby the grain diameter lies in the centimeter range and the dendrite arms exhibit a relatively large spacing of about 100 μm. On the other hand, it is desirable to have the most homogeneous structure possible with the least possible segregations, small grain diameters and small dendrite arm spacings. A casting structure that has considerable fluctuations in its composition, as caused by liquations, must be sufficiently homogenized before it can be shaped. Thus, it takes several weeks to anneal an unfavorable casting structure of a copper-nickel-tin alloy with about 15% nickel and 8% tin, for example for a homogenization treatment carried out at a temperature of about 900° C.

As a general principle, it is known that as the duration and/or temperature of the annealing treatment increases, the structure of a material coarsens due to grain growth. However, grain coarsening further reduces the deformability of a material.

Methods for manufacturing bands of copper-nickel-tin alloys are generally known. For the most part, the known methods employ conventional casting material. This material is either cold-formed after the homogenization annealing or first homogenized and then cold-formed after hot-forming.

U.S. Pat. No. 4,373,970 (EP 0 079 755 B1) discloses a method for manufacturing strips of copper base spinodal alloy, e.g. copper-nickel-tin alloys, which method employs a powder-metallurgical technique to produce commercial products. Copper base spinodal alloys can for instance be produced in a powder metallurgy manner. Separate multiphase precipitations are formed by heat treatment, thus resulting in increased strength.

The present invention is directed to the problem of developing a casting method for continuously and thus economically manufacturing copper alloys, which have a strong tendency to segregate or which are difficult to shape, e.g. higher alloyed copper-nickel-tin alloys, without difficulties arising in the subsequent processing of the casting strands into bands, bars or wires.

SUMMARY OF THE INVENTION

The present invention solves this problem by electromagnetically agitating melt found inside the ingot mold, and limiting the agitation power within the melt to within the range of 0.5 to 100 W/cm$^3$ by dimensioning the agitator coil, and likewise limiting the pull-off rate of the casting strand to within the range of 0.05 to 1.3 m/min by such dimensioning.

It is generally known to electromagnetically agitate the solidifying melt in the continuous casting of steel. So far, however, one has not been able to apply this method successfully to the continuous casting of copper alloys.

The increase in the electric conductivity of the solidified metal compared to the liquid melt is considerably greater for the copper alloy than for the steel. Due to the greater casting shell thickness and the clearly higher electric conductivity compared to the melt, a much stronger shielding effect of the melt to be agitated results through the casting shell for the electromagnetic fields of the agitator coils. Due to the relatively thick casting shell, it would make sense for an agitator device to be placed in the area of the ingot mold. However, another shielding effect is created by the copper ingot-mold plates, which as a rule are likewise 30 mm or thicker for reasons of stability.

Efficient electromagnetic agitators are needed to overcome these shielding effects. They cause a considerable amount of energy to be supplied to the melt. In principle, this leads to disadvantages.

Casting methods are known, in which the solidifying melt is agitated inductively. With these so-called levitation methods, the melt is retained during solidification by magnetic fields, without coming into contact with the walls of the ingot mold. Examples of this are the horizontal casting of flat ingots or the vertical casting of strands.

The ingot mold employed by the method of the present invention has very thin cooling walls, which are only a few millimeters thick. To achieve the required mechanical stability, a ribbed profile preferably provides reinforcement for the outer ingot-mold wall. The ingot-mold wall and the ribbed profile are designed so that the electromagnetic fields of an agitator coil are shielded only to a relatively small degree. The mold cavity of this ingot mold was provided with a thin graphite lining of about 3 mm, which provides only very little resistance to heat dissipation. The graphite lining was rounded on the outside and was brought into intensive contact with the cooled ingot-mold wall as the result of mechanical bracing. A 3-phase induction coil was arranged on the cooled exterior of the ingot mold. It made it possible for the melt to be inductively agitated inside the ingot mold. The direction of agitation was able to be selected so that the melt was moved at the sides of the ingot mold in the pull-off direction and was able to flow back to the center of the ingot mold and in the opposite direction. Melt was passed into the mold cavity of the ingot mold. This melt then intensively contacted the walls of the ingot mold, as is the case in conventional continuous casting. The melt was agitated during solidification, and the solidified strand was removed at the other end of the ingot mold. The solidified strand moved back and forth relative to the surface of the ingot mold, whereby the fore stroke was greater than the return stroke.

Thus, a 14 mm thick strand was cast using a continuous casting method at 0.25 m/min and with a consistently smooth surface. Such good cooling conditions resulted because of the intensive contact to the ingot-mold wall and the small strand thickness that the melt solidified through relatively quickly inside the strand as well, with no perceptible liquation or grain enlargement. A small strand thickness is quite significant for the method of the present invention, since the thermal conductivity of a copper alloy is only negligible—in the range of 1 to 10% of the conductivity of copper. For this reason, the dissipation of heat out of the inside of the strand is hindered somewhat. In addition, when the strand is too thick, the danger exists of intensified segregation and grain growth inside the strand.

Surprisingly, an adequate agitation effect and a proper melt solidification can be brought into harmony with one another, when the strand thickness lies in the range of 8 mm to 40 mm.

Equally significant, in addition, is the intensity of the inductive agitation of the melt. If the intensity of the agitation is too low, not enough foreign nuclei are made available as nucleating agents due to broken-off dendrite components in the melt. An agitation lacking in intensity results in an unfavorable coarse-grained structure for the subsequent processing. On the other hand, an agitation of too great intensity is also quite disadvantageous, because it means that a large amount of energy is being introduced into the strand due to the induced eddy currents.

One can describe the intensity of the agitation as the quantity of energy introduced per unit of time by the agitator into the metal to be cast. This quantity of energy can be measured with the help of a metallic test piece, which possesses the same conductivity and spatial dimensions as the metal and is introduced into the ingot mold during the casting operation. When the agitator coil is excited, this causes the temperature to rise inside the test piece. One can then calculate the input energy from this rise in temperature.

Thorough tests have shown that particularly good results are attained when the input agitation power lies in the range of 0.5 to 100 W/cm$^3$, preferably in the range of 5 to 70 W/cm$^3$. The agitation power refers thereby to a volume element of the metal to be cast, which is situated—in the pull-off direction—between the front and rear delimitation of the agitator coil.

Other important criteria are the pull-off rate of the strand and the relative movement between the strand and the wall of the ingot mold. The average pull-off rate must not be too low, because the solidification contour then shifts away from the pull-off direction, out of cooled area of the ingot mold. Under these conditions, the heat is only dissipated indirectly, thus through the strand that is already completely solidified through. As a result, the rate of cooling decreases, while the magnitude of the separation and the size of the grains in the solidified casting structure increases by an unacceptable amount.

On the other hand, the average pull-off rate must not be too high either, otherwise the liquid phase of the not yet solidified melt would be too long and narrow. The solidification contours moving towards each other then slow down the rate of agitation of the viscous melt inside the strand, so that the inside of the strand solidifies almost without having been agitated.

Therefore, the average pull-off rate must lie in the range of 0.05 up to a maximum of 1.3 m/min, preferably in the range of 0.2 to 0.7 m/min.

On the one hand, the strand can be drawn off continuously, whereby the ingot mold oscillates advantageously. On the other hand, however, the strand can be drawn off using a "push-pull" method out of the ingot mold which is not agitated. What is important, however, is the relative movement between the strand and the ingot mold. The strand moves periodically—relative to the ingot mold—by a larger forward stroke and then by a smaller return stroke. The casting shell is slightly stretched during the forward stroke, which adversely affects the transfer of heat.

During the return stroke, however, the casting shell is compressed. This causes it to be also pressed against the walls of the ingot mold, which improves the transfer of heat.

It has also been shown that a strand structure with a uniformly fine grain size and segregation fineness can only be produced when an excessively large fore stroke is not selected. On the other hand, the fore stroke must not be selected to be too small, as adequate clearance must still be provided for the return stroke. At the same time, one must not fall below the lower range limit for the pull-off rate. Furthermore, the lifting height of the oscillating ingot mold or of the forward-moving strand must be selected so that the fore stroke lies in the range of 0.5 to 30 mm.

With the continuous casting method according to the invention, a cast copper-nickel-tin strand can be produced for example, which has an extremely fine-grained structure. In a lengthwise section, individual grains are no longer visible to the naked eye. Because of the favorable solidification conditions, the segregations are also very small and finely distributed. Therefore, the casting strand can be processed further without difficulty.

The copper alloy of the method of the invention may comprise up to a maximum of 1% of one element selected from the group consisting of iron, cobalt, manganese, zinc, zirconium, chromium, molybdenum and niobium.

The copper alloy may further comprise: either a) 2 to 40% nickel and 2 to 18% tin, b) 9 to 18% nickel and 2 to 18% tin, c) 2 to 40% nickel and 5 to 10% tin, e) 5 to 18% tin or f) 8 to 13% tin; and a remainder of copper inclusive of negligible deoxidation and processing additives, as well as random impurities.

DETAILED DESCRIPTION

A thin slab of a copper-nickel-tin alloy with 15% nickel and 8% tin was continuously cast using a very thin-walled strand-casting ingot mold of a hardenable copper-chromium-zirconium alloy, whose mold cavity was lined with 3 mm thick graphite plates. The slab was 14 mm thick and 80 mm wide. The casting rate amounted to about 0.25 m/min, while the agitation power centered over the lateral section of the mold cavity was adjusted to 20 to 30 W/cm$^3$.

Figure 1:
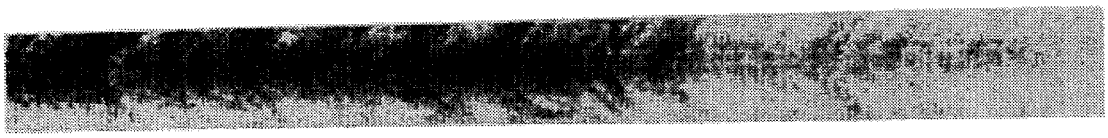
FIG. 1 depicts the microstructure in a lengthwise section through the casting strand.

The microstructure is depicted in a lengthwise section through the casting strand (FIG. 1). One can recognize that the casting strand exhibits a uniform and extremely fine-grained structure over the entire cross-section, whereby the maximum grain size amounts to 0.05 mm.

Figure 2:
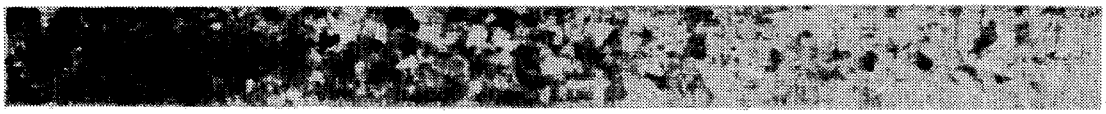
FIG. 2 depicts another lengthwise section which shows, in comparison to FIG. 1, the cast structure of a strand of a corresponding copper alloy, in which the melt was not agitated electromagnetically.

Another lengthwise section is depicted in FIG. 2. It shows, in comparison to FIG. 1, the cast structure of a strand of a corresponding copper alloys, in which the melt was not agitated electromagnetically. The grain size of this cast structure amounts to several mm.

After undergoing a surface-milling, the strand cast according to the method of the present invention was able to be cold-formed to 70 to 80% without homogenization and free-of cracks. A hot-forming was likewise carried out after a short-term homogenization at 800° to 850° C.

After undergoing a cold-forming and a suitable heat treatment, the following properties were attained for a 0.5 mm thick band:

| | | |
|---|---|---|
| Tensile strength: | 1217 | $N/mm^2$ |
| 0.2 elongation limit | 1162 | $N/mm^2$ |
| Elongation | 6 | % |
| Rockwell hardness (30 N): | 61 | |
| Grain size: | 0.005 to 0.01 | mm |

In comparison, the casting strand depicted in FIG. 2 only permitted negligible cold or hot-forming after a homogenization of several hours, as a considerable crack formation set in on the surface and, in particular, at the casting edges, whereby the cracks ran along the old casting-grain boundaries.

What is claimed is:

1. A method for continuously casting thin copper alloyed semi-finished products from copper alloys comprising 2 to 40% nickel and 2 to 18% tin, comprising the steps of:

(a) electromagnetically agitating a melt inside an ingot mold; and (b) pulling-off a casting strand from the ingot mold;

wherein the copper alloy contains a quantity of at least one element selected from the group consisting of iron, cobalt, manganese, zinc, zirconium, chromium, molybdenum and niobium, wherein the total quantity of said elements is less than or equal to 1%.

2. The method according to claim 1, wherein said copper alloy further comprises 9 to 18% nickel and 2 to 18% tin.

3. The method according to claim 1, wherein said copper alloy further comprises 2 to 40% nickel and 5 to 10% tin.

4. The method according to claim 1, wherein the copper alloy further comprises 9 to 18% nickel and 5 to 10% tin.

5. The method according to claim 1, wherein the copper alloy further comprises 5 to 18% tin.

6. The method according to claim 1, wherein the copper alloy further comprises 8 to 12% tin.

7. The method according to claim 1, wherein the copper alloy does not tend to segregate during solidification.

8. A method for continuously casting thin copper alloyed semi-finished products from copper alloys, comprising 2 to 40% nickel and 18% tin, comprising the steps of:

(a) electromagnetically agitating a melt inside an ingot mold, an agitation power inside the melt being within a range of about 5 to 100 $W/cm^3$; and (b) pulling-off a casting strand from the ingot mold at a range of 0.05 to 1.3 m/min;

wherein the copper alloy contains a quantity of at least one element selected from the group consisting of iron, cobalt, manganese, zinc, zirconium, chromium, molybdenum and niobium wherein the total quantity of said elements is less than or equal to 1%.

9. The method according to claim 8, wherein said copper alloy further comprises 9 to 18% nickel and 2 to 18% tin.

10. The method according to claim 8, wherein said copper alloy further comprises 2 to 40% nickel and 5 to 10% tin.

11. The method according to claim 8, wherein the copper alloy further comprises 9 to 18% nickel and 5 to 10% tin.

12. The method according to claim 8, wherein the copper alloy further comprises 5 to 18% tin.

13. The method according to claim 8, wherein the copper alloy further comprises 8 to 12% tin.

14. The method according to claim 8, wherein the copper alloy does not tend to segregate during solidification.

* * * * *

UNITED STATES PATENT AND TRADEMARK OFFICE

CERTIFICATE OF CORRECTION

PATENT NO. : 5,553,660

DATED : Sep. 10, 1996

INVENTOR(S) : KRAUS et al.

It is certified that error appears in the above-indentified patent and that said Letters Patent is hereby corrected as shown below:

In column 4, line 57, chang "alloys" to --alloy--;

In column 6, line 8, change "and 18%" to --and 2 to 18%--;

In column 6, line 18, change "niobium" to --niobium,--.

Signed and Sealed this

Thirty-first Day of December, 1996

Bruce Lehman

*Attest:*

BRUCE LEHMAN

*Attesting Officer*

*Commissioner of Patents and Trademarks*